US009878835B2

(12) United States Patent
Winter

(10) Patent No.: US 9,878,835 B2
(45) Date of Patent: Jan. 30, 2018

(54) LOOP FORMING FASTENER

(71) Applicant: Philip Winter, Portland, OR (US)

(72) Inventor: Philip Winter, Portland, OR (US)

(73) Assignee: Loop Ties LLC, Eugene, OR (US)

( * ) Notice: Subject to any disclaimer, the term of this patent is extended or adjusted under 35 U.S.C. 154(b) by 42 days.

(21) Appl. No.: 14/741,099

(22) Filed: Jun. 16, 2015

(65) Prior Publication Data

US 2016/0368680 A1 Dec. 22, 2016

(51) Int. Cl.
*B65D 63/10* (2006.01)

(52) U.S. Cl.
CPC ..... *B65D 63/1081* (2013.01); *B65D 63/1072* (2013.01); *B65D 2563/103* (2013.01)

(58) Field of Classification Search
CPC ..... Y10T 24/1498; B65D 63/1063; B65D 63/1081; B65D 2563/108; B65D 2563/103
See application file for complete search history.

(56) References Cited

U.S. PATENT DOCUMENTS

| | | | | |
|---|---|---|---|---|
| 3,186,047 | A | 6/1965 | Schwester et al. | |
| 3,457,598 | A | 7/1969 | Mariani | |
| 3,488,813 | A | 1/1970 | Kohke | |
| 3,590,442 | A | 7/1971 | Geisinger | |
| 3,618,173 | A | 11/1971 | Schwartz | |
| 3,739,429 | A | 6/1973 | Kohke | |
| 5,088,159 | A | 2/1992 | Lafleur | |
| 5,819,375 | A * | 10/1998 | Kastner | F16L 3/2332 24/16 PB |
| 6,105,210 | A | 8/2000 | Benoit | |
| 6,185,792 | B1 | 2/2001 | Nelson et al. | |
| 8,413,306 | B2 | 4/2013 | Gallant et al. | |
| 8,516,660 | B2 | 8/2013 | Ku | |
| 2006/0096066 | A1 | 5/2006 | Wambaugh et al. | |
| 2007/0234524 | A1 | 10/2007 | Witt | |
| 2008/0184538 | A1 | 7/2008 | Shellnutt | |
| 2014/0082923 | A1 | 3/2014 | Owen | |

FOREIGN PATENT DOCUMENTS

DE 1957502 A1 6/1970

OTHER PUBLICATIONS

Winter, Philip, "Cable Management Products Currently Available", compilation, Mar. 1, 2015, 18 pages, Portland, Oregon.
Partial Supplemental European Search Report prepared by the European Patent Office for EP 15 809 026.6; Oct. 17, 2017, 15 pages.

* cited by examiner

*Primary Examiner* — Robert J Sandy
(74) *Attorney, Agent, or Firm* — Chernoff Vilhauer LLP

(57) ABSTRACT

A loop forming fastener including a ratchet and locking features that can be utilized to provide for a desired loop size. The loop forming fastener may include an elongate body portion having a first end and an opposite tail portion, with a head connected to the elongate body, the head defining an opening configured to receive the elongate body to form a loop. A ratchet may allow movement of the body through the opening in a first direction, but prevents movement in a second direction. The elongate body may include a stopper to maintain at least a minimum loop size. The head may include a locking mechanism to lock the elongate body, and thereby establish a desired size of the loop.

10 Claims, 10 Drawing Sheets

LOOP FORMING FASTENER

CROSS-REFERENCE TO RELATED APPLICATIONS

This invention claims the benefit of provisional application 62/014,084, filed on Jun. 18, 2014, and provisional application 62/046,175, filed on Sep. 5, 2014.

BACKGROUND OF THE INVENTION

Loop forming fastening systems, such as zip ties, are versatile and highly useful devices. Most zip ties are made as injection moldings of tough resilient plastics and function by forming a loop that can be tightened until a feature or an object being secured is completely secured and encompassed by a loop of the fastener. A shortcoming of such zip ties is that a user cannot form the loop such that the loop is locked at a selected size. Conventional zip ties generally continue to tighten the loop as long as the zip tie tail is pulled through the head.

For some applications conventional zip ties may not be suitable. For example, an over-tightened loop might create a flow restriction by compressing a flexible fluid line. Conventional zip ties may also not be suitable for applications that require specific loop sizes.

SUMMARY OF THE INVENTION

The following disclosure provides loop forming fasteners with loop size defining features as defined by the following claims, which form a part of this disclosure. In some embodiments, the fasteners disclosed herein can function as conventional zip ties while providing the additional functionality of making size-secured loops of any size.

In an embodiment incorporating an aspect of the invention, a loop forming fastener includes an elongate body having a first end, an opposite tail portion and an intermediate portion generally located between the first end and the opposite tail portion. The elongate body may be generally rectangular in section and thus may include a first side and an opposite second side. The fastener may also include a head, connected to the first end of the elongate body and defining an opening through the head configured to receive the tail portion and the intermediate portion of the elongate body to form a loop. The fastener may also include a ratchet mechanism that permits movement of the body through the opening in a first direction, but prevents movement in an opposite direction, and an additional part that prevents the loop from being reduced to less than a predetermined size.

One embodiment of the fastener may include a stopper located on the elongate body, the stopper being too large to pass easily through the opening of the head. Such a stopper can function to limit the distance to which the elongate body can be passed through the head and thus establish a predetermined minimum size of the loop or restrict the size of the final loop created when securing the tail to the head of the fastener.

The fastener may also include a locking mechanism associated with the head which can be activated when a desired loop size has been achieved, to hold the elongate body within the head at a selected loop size.

Other embodiments may include loop forming fasteners with single or multiple elongate body portions, single or multiple heads, or a combination of single and multiple elongate body portions and/or heads.

The foregoing and other features and advantages of the invention will be more readily understood upon consideration of the following detailed description of the invention taken in conjunction with the accompanying drawings.

BRIEF DESCRIPTION OF THE SEVERAL DRAWINGS

DETAILED DESCRIPTION OF PREFERRED EMBODIMENTS

Figures 1, 2:
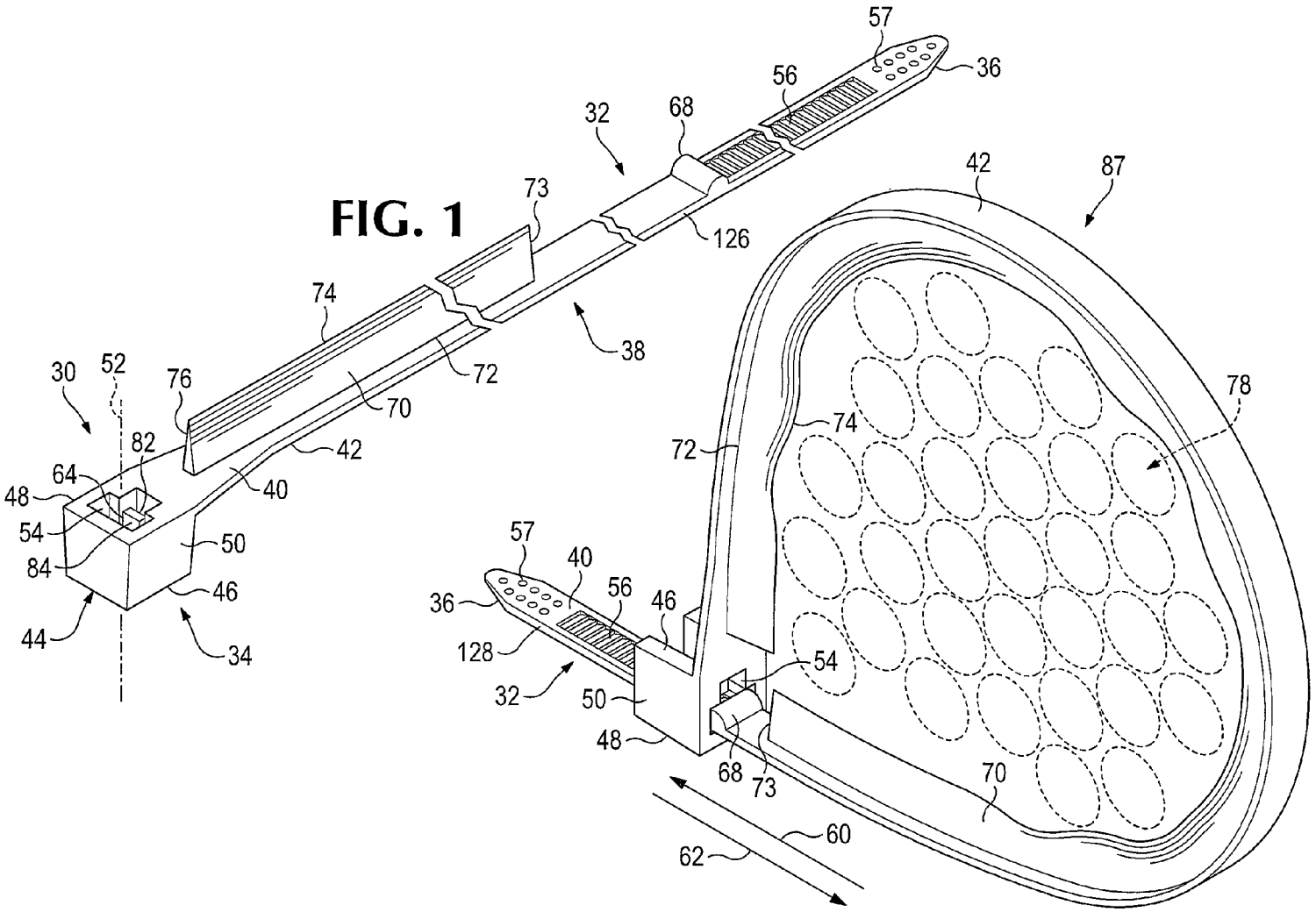
FIG. 1 is an isometric view of a first embodiment of the loop forming fastener.
FIG. 2 is an isometric view of the fastener shown in FIG. 1 in a secured loop configuration.

Referring now to the drawings which form a part of the disclosure herein a loop forming fastener 30 shown in FIG. 1 may include an elongate body portion 32 having a first end 34 and an opposite tail portion 36 with an intermediate portion 38 generally situated between the first end 34 and the tail portion 36. The portion 32 of the fastener 30 may be ribbon-like in general form and include an inner, or first side 40 and an outer, or second side 42, as well as a pair of relatively narrow edges, a third side 126 and a fourth side 128. The fastener 30 may be formed of a strong, resiliently flexible and moldable plastics material.

The fastener 30 also includes a head 44 connected to the elongate body 32 at the first end 34. The head may be collar-like, with a top 46 and a bottom 48 and a pair of spaced-apart sides 50. The head 44 may also define an axis 52 of an opening or passageway 54 through the head 44, oriented in this case in a direction perpendicular to the length of the elongate body 32. However, a user may choose to have the axis in different directions than perpendicular to the direction of the elongate body 32. The opening or passageway 54 extending in the direction of the axis 52 through the head, may be configured to receive the elongate body 32 to pull the elongate body 32 through the head 44 to form a loop of the intermediate portion 38, as shown in FIG. 2.

The fastener 30 may include a ratchet mechanism including an array of teeth 56 located on and extending along the first side 40 of the tail portion 36 of the elongate body portion 32, and a pawl 82 associated with the head 44 and the opening 54. Such a ratchet mechanism (a combination of the teeth 56, the head 44 and the pawl 82) permits movement of the elongate body portion 32 in a first direction indicated by the arrow 60, but prevents movement in the opposite direction indicated by the arrow 62, as shown in FIG. 2. The pawl 82 may be constructed to have other geometric configurations other than that shown, including, but not limited to, including a tooth-like or barb-like protrusion. The array of teeth 56 may be located at a predetermined distance away from the head, as the position of the teeth 56 closest to the head 44 in some embodiments determines the minimum size of the formed loop.

Figure 5:
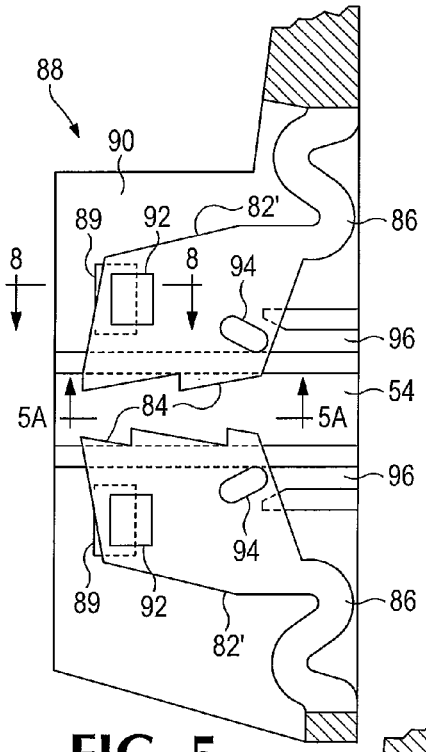
FIG. 5 is an enlarged sectional view of the fastener head shown in FIG. 3, taken along line 5-5, showing the fastener locking mechanism in an unlocked condition.
Figure 6:
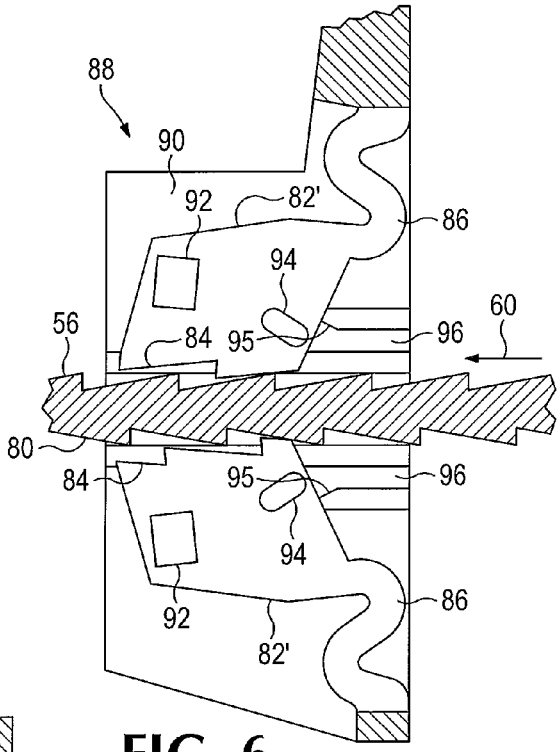
FIG. 6 is an enlarged sectional view of the fastener head shown in FIG. 5, with a portion of the elongate body extending through the fastener head, in an unlocked condition.
Figure 7:
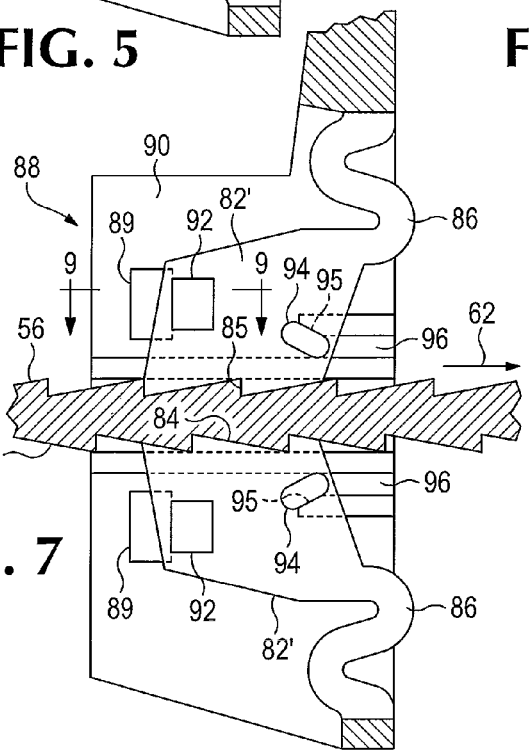
FIG. 7 is an enlarged sectional view taken along line 7-7 in FIG. 4, showing the fastener head shown in FIG. 6, with a portion of the elongate body extending through the fastener head, but in a locked condition.

In some embodiments, the pawl 82 includes an engaging body 64 including a pawl face 84. The pawl 82 may be located within the opening 54, and may be carried on a resiliently flexible neck such as, but not limited to, a flexible S-shaped neck 86 as shown in FIGS. 5-7, which, in one embodiment, may extend from a mounting location within the opening 54. In other embodiments, the pawl 82 may be mounted outside of the opening 54, such as, for example, on a side 50 of the head 44. The flexible neck may be of other shapes, for example other arcuate shapes, that provide ability to move, or be flexible.

The tail portion 36 may also include a surface configuration 57 such as small rubber protrusions adapted to be gripped securely by a user's hand, to be employed, for example, as a user grips the tail portion 36 to pull it through the head opening 54 to form a loop 87 as shown in FIG. 2. The style and design of the elongate body 32 can be of many different varieties that involve interaction with another feature or features to allow the elongate body 32 to form a loop 87 which can be tightened to a desired circumference.

In a first embodiment of the loop forming fastener 30, as shown in FIGS. 1 and 2, the fastener 30 may include a stopper 68 in the form of a solid bumper or protrusion located on the first side 40 of the intermediate portion 38 of the elongate body 32. Such a stopper may be conveniently shaped and of a size that is too big to pass through the opening 54, thereby preventing further movement of the elongate body 32 through the head 44 in the direction of the arrow 60, and locking the loop 87 in position, establishing a predetermined minimum loop size, as shown in FIG. 2. In FIGS. 1 and 2, the stopper 68 has a half-cylindrical, or curved, shape extending outward from the first side 40 of the intermediate portion 38 of the elongate body 32, but the stopper 68 may take other forms with similar functions, as will be described herein with reference to FIGS. 24-28. In other embodiments, the loop forming fastener does not include any type of stopper.

The fastener 30 may also, but does not always need to, include a grip-enhancing flexible fin 70 in the form of an elongate piece of flexible material extending along the inner side 40 of the intermediate portion 38 of the elongate body 32. Such a fin 70 may be tapered from a base 72 to a narrower outer edge 74, which may be parallel to the base 72. The base 72 may be attached to the first side 40 of the intermediate portion 38 of the elongate body 32 by means of an adhesive, or the fin 70 may be molded as an integral part of the loop forming fastener 30. An end 73 of the flexible fin 70 may be used as a stopper similar to the function of the stopper 68, eliminating the need for a separate stopper.

As best shown in FIG. 2, in use, the flexible fin 70 extends along the inner circumference of the loop 87 and surrounds and bears upon the items 78 within the loop 87. The material 70 of the flexible fin may be elastic, deformable, spongy, rubbery, and/or soft, such that it can conform flexibly to grip and provide additional friction and well-distributed pressure to secure the items 78 wrapped by the loop 87 in a user-selected position. In addition, the flexible fin 70 protects the items 78 from potential abrasion that might otherwise occur due to contact and movement between the items 78 and the first side 40 of the elongate body 32. Such protection from abrasion is particularly important when such fasteners 30 are used to secure electrical wires. The loop forming fastener 30 including the flexible fin 70 may also be useful for situations where groups of items 78 to be fastened vary in diameter, reducing the number of different sized loop ties users would need to meet their various diameter needs.

FIGS. 3-9 show a head 44' and a portion of the elongate body 32 of a loop forming fastener 88 incorporating a second embodiment of the ratchet mechanism that can secure a loop at a user-selected size. In the loop forming fastener 88, the intermediate body portion 38 includes an array of teeth 56 on the first side 40 of the elongate body 32 and a second array of teeth 80 on the second side 42 of the elongate body 32, as best shown in FIGS. 6 and 7.

Figure 5A:
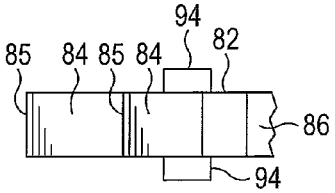
FIG. 5A is an enlarged detail view of the pawl shown in FIG. 5, taken along line 5A-5A.
Figure 8:
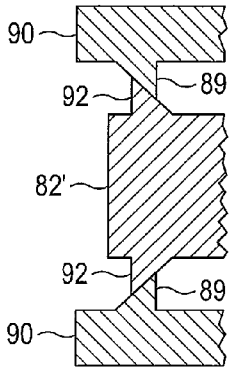
FIG. 8 is an enlarged sectional view of the locking mechanism of the fastener head, taken along line 8-8 in FIG. 5.
Figure 9:
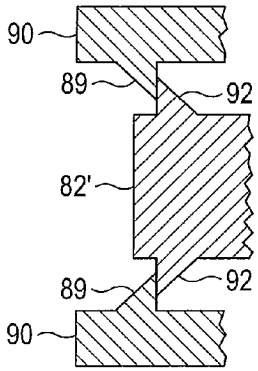
FIG. 9 is an enlarged sectional view of the locking mechanism of the fastener head, taken along line 9-9 in FIG. 7.

The ratchet and locking mechanism of the fastener 88 includes two similar, but opposing, pawls 82'. Each pawl 82' is supported on an s-shaped flexible neck 86 mounted to a part of the head defining the opening 54 and includes a pawl face 84, including a pair of pawl edges 85 shaped to fit with respective ones of the teeth 56 and 80, as viewed in FIG. 5A.

Figure 4:
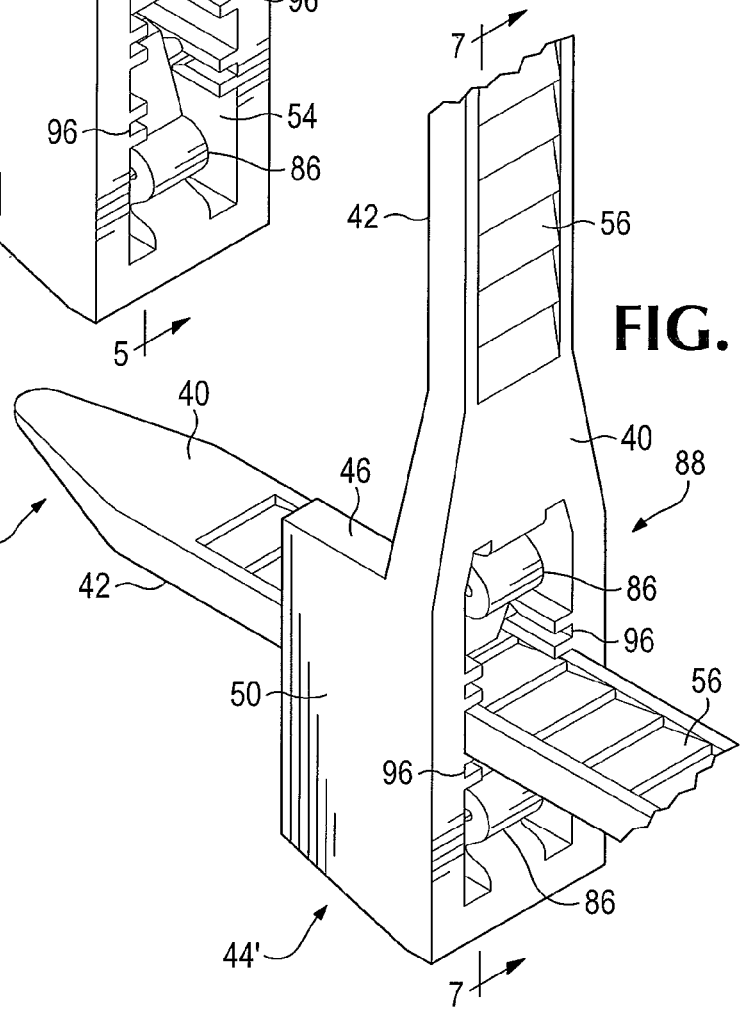
FIG. 4 is an enlarged isometric view of the fastener head shown in FIG. 3 engaged with a part of the elongate body.

To form a loop 87, as shown in FIGS. 4 and 6, the elongate body portion 32 is passed through the opening 54 and pulled in the direction of the arrow 60. The s-shaped flexible necks 86 allow the pawls 82' to be deflected by the teeth 56, 80 as the elongate body 32 is pulled through the opening 54, as best shown in FIG. 6.

The fastener head 44' of the loop forming fastener 88 includes locking shoulders 89, which extend from the inner face of the wall 90 of each side of the head 44', into the opening 54. The pawls 82' include correspondingly located protruding catches 92 which extend outward from the sides of the pawls 82' in the direction of the adjacent inner wall 90, as best viewed in FIGS. 8 and 9.

To lock the fastener 88 to form a loop 87 at a selected loop size, so that the loop 87 cannot thereafter get smaller, elongate body portion 32 is pulled in the direction of the arrow 62, to move the pawls 82' to the positions shown in FIG. 7. When the elongate body portion 32 moves in the direction of the arrow 62, the teeth 56 and 80 engage the faces 84 of the pawls 82'; the catches 92 are pulled in the direction of the arrow 62, bending and moving the s-shaped flexible necks 86 in the direction of the arrow 62. The pawls 82 thus carry the catches 92 beyond the locking shoulders 89, thereby locking the pawls 82' in the position shown in FIGS. 7 and 9.

The head 44' of the loop forming fastener 88 may also include guide protrusions 94 on the sides of the pawls 82' and pawl guides 96 on the inner faces of the walls 90. The guide protrusions 94 extend outward toward the inner face of the wall 90 of the adjacent side of the head 44', from the sides of the pawls 82'. The pawl guides 96 may be elongate rail-like elements which extend from the inner wall 90 of the side of the head 44' into the opening 54, and may include cam faces 95 in position to be engaged by the guide protrusions 94 to urge the pawls 82' toward each other. When a user pulls the elongate body 32 in the direction of the arrow 62, the guide protrusions 94 are also pulled under the pawl guides 96, as best shown in FIGS. 6 and 7, thereby squeezing the pawls 82' toward the elongate body portion 32 and forcing the faces 84 of pawls 82' into engagement with the teeth 56 and 80.

It will be understood that the fastener head could be made with only one of the pawls 82' and a smooth bottom 48 as shown in FIGS. 1 and 2 and that the elongate body 32 could have a smooth outer side 42 as shown in FIG. 2, with only one array of teeth 56 on the elongate body 32.

A loop forming fastener 97 of which a fastener head 44" and a part of the elongate body portion 32 are shown in FIGS. 10-13 incorporate a third embodiment of the ratchet and locking mechanism. The ratchet mechanism is similar to the one previously described and shown in FIGS. 3-6 and also includes additional locking components which function to secure the elongate body 32 to the head 44" to provide a user-selected loop size.

The elongate body 32 of the loop forming fastener 97 includes respective arrays of teeth 56, 80 on the first and second sides of the elongate body 32 and an array of holes 98 which extend into, and may extend through, the elongate body portion 32 from the outer side 42 or the inner side 40. As a variation, the body portion 32 may have an array of teeth 56 on only the first side 40, or on only the second side 42.

Figure 10:
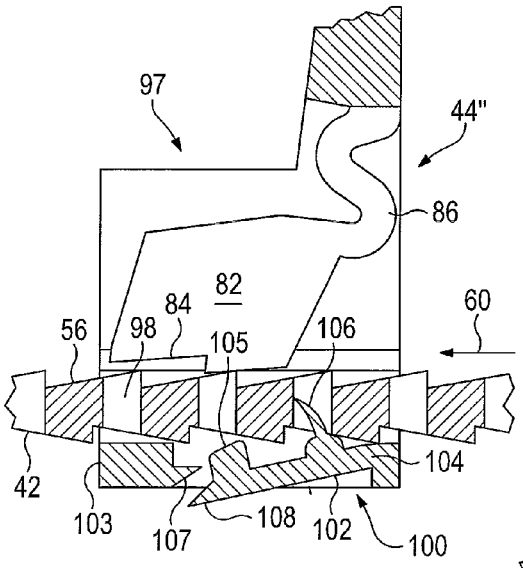
FIG. 10 is an enlarged sectional view of a fastener head incorporating a third embodiment of the fastener locking mechanism, with a portion of the elongate body extending through the fastener head, in an unlocked condition.
Figure 12:
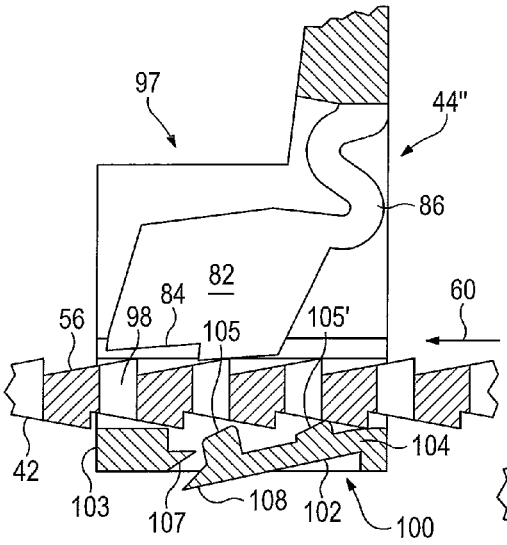
FIG. 12 is an enlarged sectional view of the head of a fastener incorporating a fastener locking mechanism similar to that shown in FIGS. 10 and 11, with a portion of the elongate body extending through the fastener head, in an unlocked position.

The ratchet mechanism in the loop forming fastener 97 includes a pawl 82 with a pawl face 84, and the pawl 82 may be mounted to the head opening 54 by means of an s-shaped flexible neck 86. To form a loop as the elongate body portion 32 is pulled in the direction of the arrow 60, the s-shaped flexible neck 86 allows the pawl 82 to be deflected by the teeth 56 as the arrays of teeth 56, 80 move through the passageway 54 in a ratcheting manner, as best shown in FIGS. 10 and 12.

Figure 11:
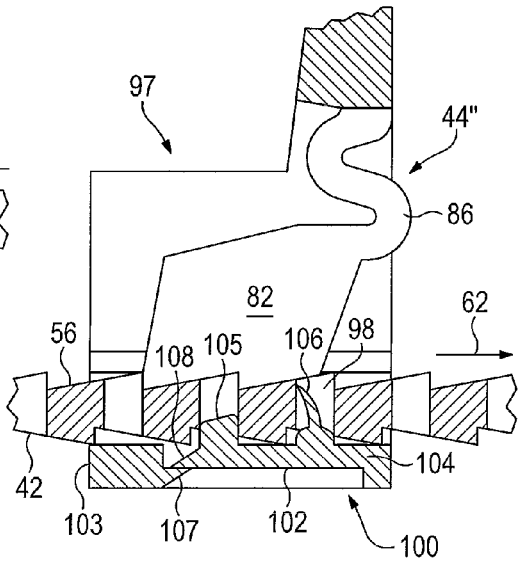
FIG. 11 is an enlarged sectional view similar to FIG. 10, showing the fastener locking mechanism with a portion of the elongate body extending through the fastener head, but in a locked condition.
Figure 13:
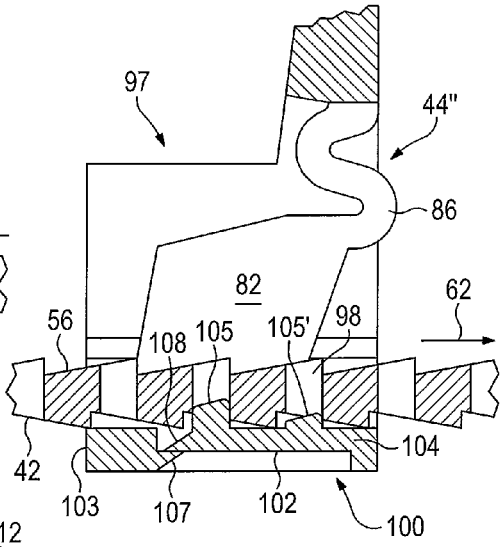
FIG. 13 is an enlarged sectional view similar to FIG. 12, showing a portion of the elongate body extending through the fastener head, but in a locked condition.

The locking mechanism of the loop forming fastener 97 is shown generally at 100. The locking mechanism 100 includes a foot 102 that extends along the outer end 103 of the head 44", in the direction in which the elongate body portion 32 can be moved through the ratchet mechanism. The foot 102 is attached to the bottom of the head 48 at a resiliently flexible base 104 adjacent the opening 54. In FIGS. 10 and 11, the foot 102 includes a cog or catch 105 and a barb 106 on the cog 105, extending from the foot and extending into one of the holes or cavities 98 when the hole 98 is adjacent the catch 105 or the barb 106. The barb 106 is deflected and may itself flex and force the foot 102 to flex down and away from the elongate body 32 when a non-cavity portion of the body 32 is adjacent the barb 106. In the embodiment shown in FIGS. 12-13, a barb is not employed, thereby utilizing a second cog or catch 105' that can ride over the teeth 80 as shown in FIGS. 12-13. An outer end wall 103 of the head 48 includes a locking shoulder 107 which is structured to engage a catch 108.

To lock a loop 87 formed by the fastener 97 at a selected loop size, so that the loop cannot get smaller, (while the ratchet mechanism also prevents enlargement of the loop 87) the foot may be pressed manually toward the cavities 98 to engage the cog 105 and the barb on the cog 105, or the second cog 105', thereby engaging the catch 108 with the locking shoulder 107. Alternatively, for the embodiment shown in FIGS. 10 and 11, to lock a loop 87 formed by the fastener 97, the elongate body portion 32 is pulled in the direction of the arrow 62, as shown in FIG. 11. Pulling the body 32 in the direction of the arrow 62, the cog 105 and the barb 106 are secured in corresponding holes or cavities 98, thereby pulling the foot 102 to pivot upward about the flexible base 104, in the direction of movement of the elongate body 32, and pulling the catch 108 over the locking shoulder 107. At the same time, the pawl face 84 engages with the teeth 56 on the first side 40 of the elongate body 32, therefore preventing any further movement of the body 32 in the direction of the arrow 60.

A head 110 and a portion of an elongate body 111 shown in FIGS. 14-17 are incorporated in another lockable loop forming fastener 112 which is a fourth embodiment. The lockable loop forming fastener 112 includes a ratchet mechanism similar to that previously described in the loop forming fastener 30, and also includes locking components which function to secure the elongate body 111 to the head 110 to provide a user-selected loop size.

The elongate body 111 includes an array of sloping ratchet teeth 56 on its first side 40 and may also include an array of sloping ratchet teeth 80 on its second side 42. An additional array of narrow sloping teeth 109 is provided on the first side 40, alongside the teeth 56, and a further array of such teeth (not shown) may also be included on the second side 42 of the elongate body 111. The narrow teeth 113 are sloped in the opposite direction as the sloping ratchet teeth 56 and may be relatively small. In a variation of the elongate body 111, there is also a second array of narrow teeth 109', such that arrays of narrow teeth 109, 109' are on each side of the array of teeth 56 on the first side 40, as best viewed in FIG. 14A, and also may be on each side of the array of sloping ratchet teeth 80 of the second side of the elongate body 111.

The ratchet mechanism of the loop forming fastener 112 includes a pawl 82 with a pawl face 84, with the pawl 82 located within the passageway 54 defined by the head 110 and mounted on a short flexible neck 130. Similar to previously-described loop forming fasteners, to form a loop, the elongate body 111 is fed through the head 110 and moved in the direction of the arrow 60, the short flexible neck 130 allows the pawl 82 to be deflected as the arrays of teeth 56, 80 are pulled through the passageway 54.

A locking mechanism in the loop forming fastener 112, shown generally at 100, includes a latch 114 that is flexibly or rotatably mounted at a point of attachment 115 on either the inner face of a side wall of the head 110, or the side of the pawl 82 which faces the inner face 90 of the wall of the head 110, as by being carried on a resiliently flexible neck 116. The latch body 114 includes a toothed latch edge 117 which corresponds to the shape of the narrow array of teeth 109.

The head 110 may also include a locking shoulder 118, which extends into the passageway 54, from the inner face of the wall 90 of the side of the head 110, a short distance from the narrow teeth 113. The latch body 114 may include a protruding catch 127 which extends outward from the side of the latch body 114, toward the inner face 90 of the side wall of the head 110, as best seen in FIG. 15A.

Figure 14:
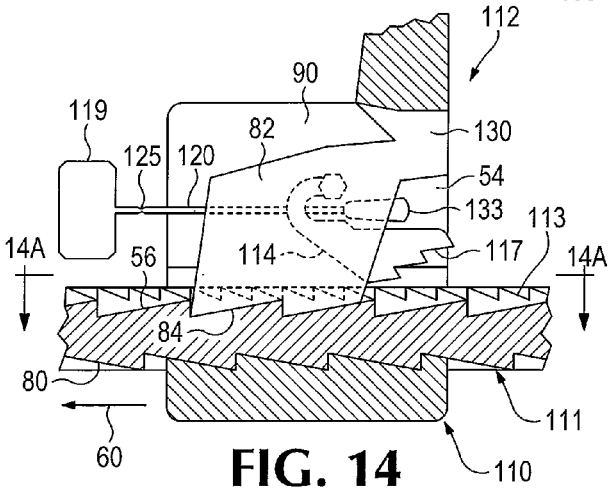
FIG. 14 is an enlarged sectional view of the head of a fastener incorporating a fourth embodiment of the fastener locking mechanism, with a portion of the elongate body extending through the fastener head, in an unlocked condition.
Figure 14A:
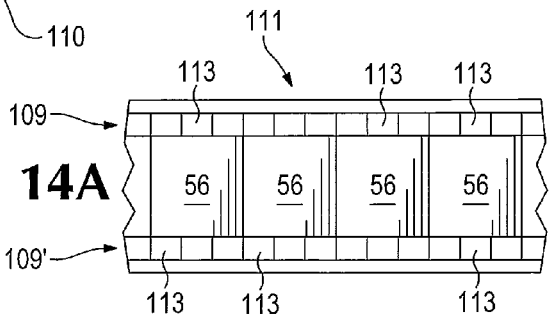
FIG. 14A is a view of a portion of the elongate body, taken in the direction of line 14A-14A in FIG. 14.
Figure 15:
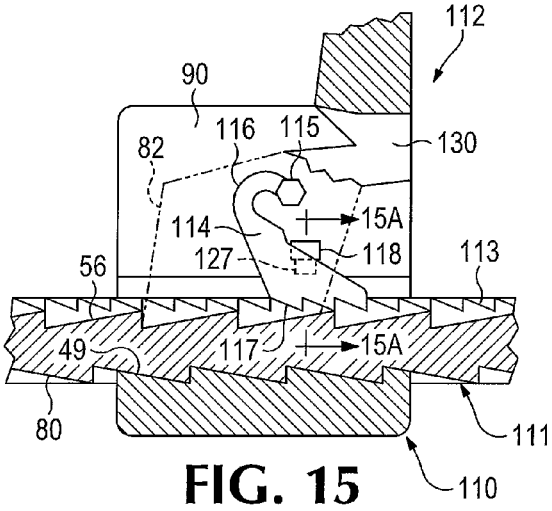
FIG. 15 is an enlarged sectional view similar to FIG. 14, showing the fastener locking mechanism with a portion of the elongate body extending through the fastener head, but in a locked condition.

To lock the fastener 112 at a chosen loop size, there may be a pull tab 119 interconnected with the latch body 114, through a slender neck 120, and which functions to engage the latch body 114, and thereby the latch edge 117, with the narrow array of teeth 109 to lock the elongate body 111, at a user-selected position in the head 110. A slender connecting portion of the pull tab 119 may include a necked-down break-off point 125. In one configuration of the pull tab 119, as shown in FIG. 14, the far end of the tab is attached to the inner side of the side wall 90 of the head 110. In another configuration, the pull tab 119 is manufactured separately from the fastener 30 and is attached to the fastener 30 after the fastener is manufactured. When the pull tab 119 is pulled in the direction indicated by the arrow 60, a body or knob 133 at the far end of the neck 120 engages the latch body 114, and moves the latch body 114 such that latch edge 117 engages with the array of narrow teeth 113 as shown in FIG. 15, stopping further movement of the elongate body 111 in a loop-tightening direction. In some embodiments, following the engagement of the latch body 114 with the array of narrow teeth 109, the tab 119 may be pulled or broken off.

Figure 16:
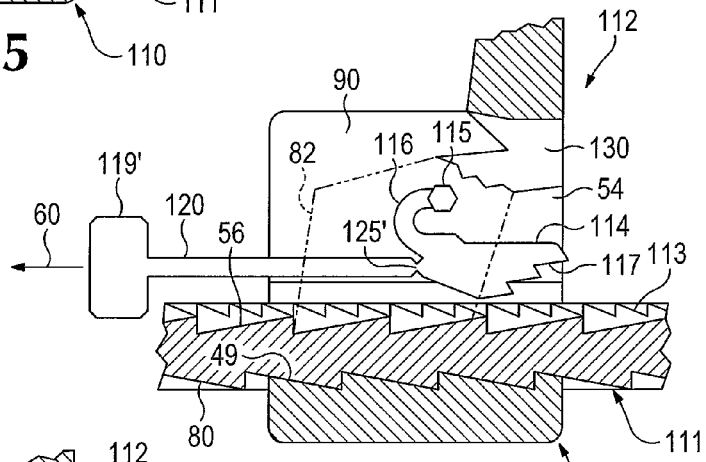
FIG. 16 is an enlarged sectional view of the head of a fastener incorporating a variation of the fastener locking mechanism shown in FIGS. 14 and 15, with a portion of the elongate body extending through the fastener head, in an unlocked condition.

In another configuration, a pull tab 119', as shown in FIG. 16, has the end of its slender connecting portion attached to the latch body 114 at its necked-down break-off point 125'. When the pull tab 119' is pulled in the direction of the arrow 60, it pulls the latch body 114 so that the latch edge 117 engages with the array of narrow teeth 109. In some embodiments, the tab 119' may be broken off of the latch 114 at breaking point 125'.

Figure 15A:
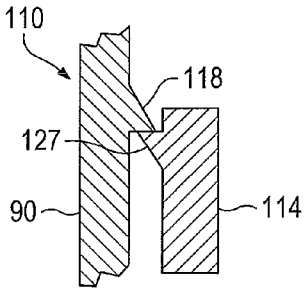
FIG. 15A is an enlarged view of a detail of the head, taken in the direction of line 15A-15A in FIG. 15.
Figure 17:
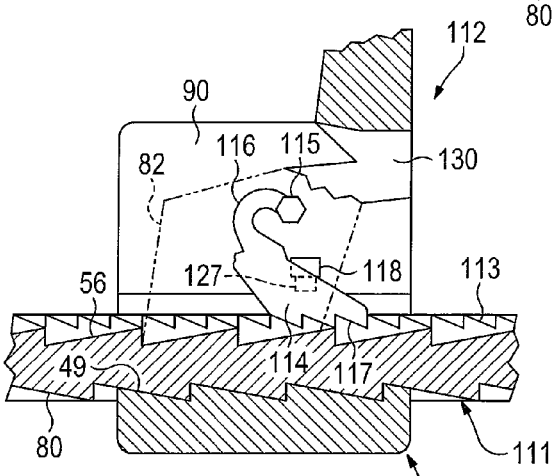
FIG. 17 is an enlarged sectional view similar to FIG. 16, but with the locking mechanism engaged and the portion of the elongate body held in a locked condition.

As the latch body 114 is moved to where the latch edge 117 engages the narrow teeth 113, the latch body 114 is locked in that engaged position, as shown in FIGS. 15 and 17, by engaging the catch 127 as shown in FIG. 15A with the locking shoulder 118, thereby preventing the latch body 114 from returning to its disengaged position shown in FIGS. 14 and 16. The engagement of the latch body 114 with the narrow teeth 113 locks the elongate body against further reducing the size of the loop 87.

Figure 18:
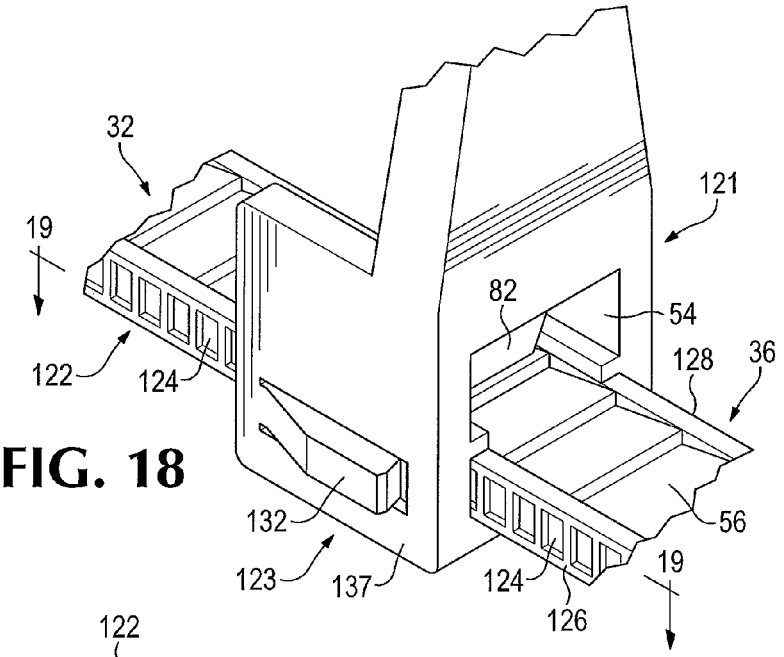
FIG. 18 is an enlarged isometric view of a fastener head and a portion of an elongate body incorporating a fifth embodiment of the fastener locking mechanism, showing a portion of the elongate body extending through the fastener head, in an unlocked condition.
Figure 19:
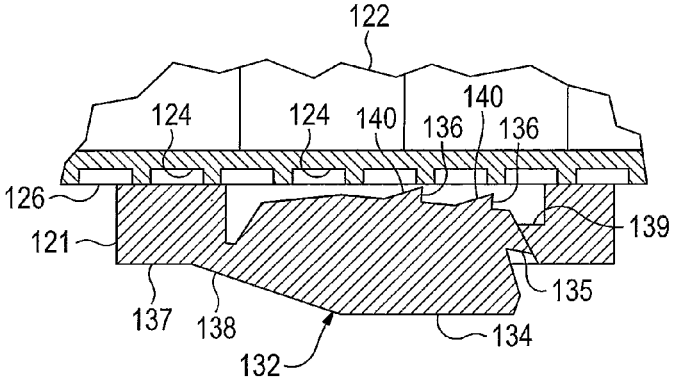
FIG. 19 is an enlarged sectional view taken along line 19-19 in FIG. 18, showing a part of the locking mechanism of the fastener head shown in FIG. 18, with a portion of the elongate body held in an unlocked condition.
Figure 20:
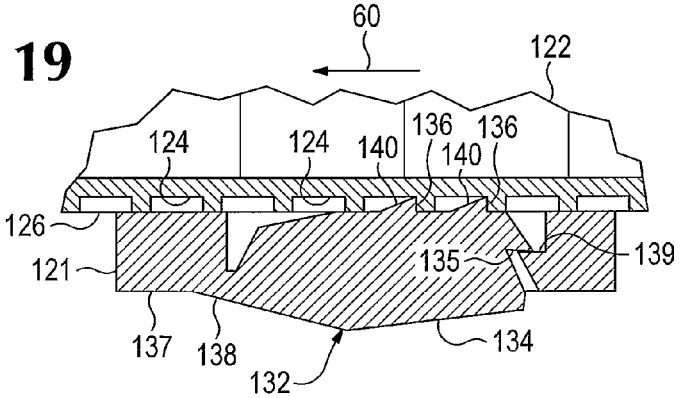
FIG. 20 is an enlarged sectional view similar to FIG. 19, showing a portion of the elongate body extending through the fastener head, but in a locked condition.

A loop forming fastener head 121 and a portion of an elongate body 122 incorporating a further embodiment of the present loop forming fastener 123 are shown in FIGS. 18-20. The elongate body 122 and engagement of the ratchet pawl 82 with the teeth 56, keeps the loop 87 from being enlarged. Elongate body 122 includes an array of teeth 56 on its first side 40, a pawl 82 similar to that shown in FIG. 16, for example, is provided to complete the usual ratchet mechanism. As a variation, the elongate body 122 could also include an array of teeth 80 on its second side 42, and the head could incorporate a pair of pawls similar to the pawls 82 as shown in FIGS. 3-7 or feature corresponding teeth 49 incorporated into the head 44, as shown in FIGS. 14, 15, 16, and 17. The elongate body 122 also includes an array of depressions 124 located on each of the third and fourth sides 126, 128 of the elongate body 122, although depressions 124 could optionally be provided in only one of the third side 126 or fourth side 128, but not in both.

Figure 3:
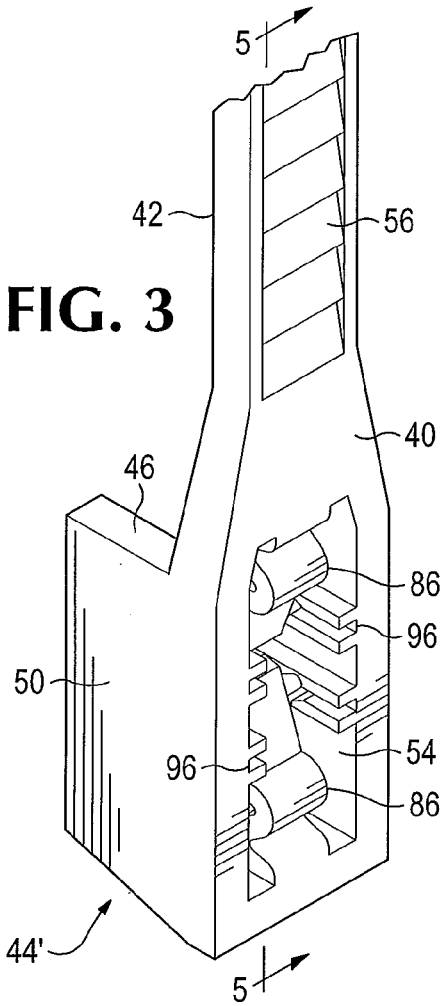
FIG. 3 is an enlarged isometric view of a fastener head incorporating a second embodiment of the fastener locking mechanism.

Either an s-shaped flexible neck 86 as shown in FIGS. 3-5 or a short flexible neck 130 as shown in FIG. 18 allows the pawl 82 to be deflected by the array of teeth 56 as the elongate body 122 is pulled through the passageway 54.

As a locking mechanism to cooperate with the just-described ratchet mechanism, the loop forming fastener 123 may include at least one locking button 132 located in a side of the head 121 adjacent the third side 126 of the elongate body 32. Although not shown, there may also be an additional locking button 132 in the opposite side of the head 121 adjacent the fourth side 128 of the elongate body 122, arranged in mirror image fashion to relate to the depressions 124 in that side 128 of the elongate body 122.

The locking button 132 includes an outer portion 134 and at least one and optimally more than one depression-engaging teeth 136 on an inner face. The locking button 132 may include texture or grip-enhancing features (not shown). A catch 135 is at a free end, opposite a flexible button neck 138 connecting the button to the side wall 137 of the head 121. The teeth 136 may have inclined surfaces 140 that act as cams to guide the teeth 136 into respective ones of the depressions 124 when the button 132 is pressed inward toward the elongate body 122 depressions 124.

To lock the fastener 123 at a selected loop size, the locking button 132 should be pressed toward the depressions 124, bending the flexible button neck 138. This pushes the teeth 136 into the adjacent depressions 124 in the side 126 of the elongate body 122, as shown in FIG. 20, to prevent further movement of the elongate body 122 in the direction indicated by the arrow 60. In addition, this pushes the catch 135 beyond the locking shoulder 139, latching it so that once the locking button 132 is released, the locking shoulder 139 engages the catch 135 and keeps the locking button 132 in place, thereby securing the teeth 136 in position to prevent the elongate body 122 from moving in the direction indicated by arrow 60, so as to shrink the loop 87.

Figure 21:
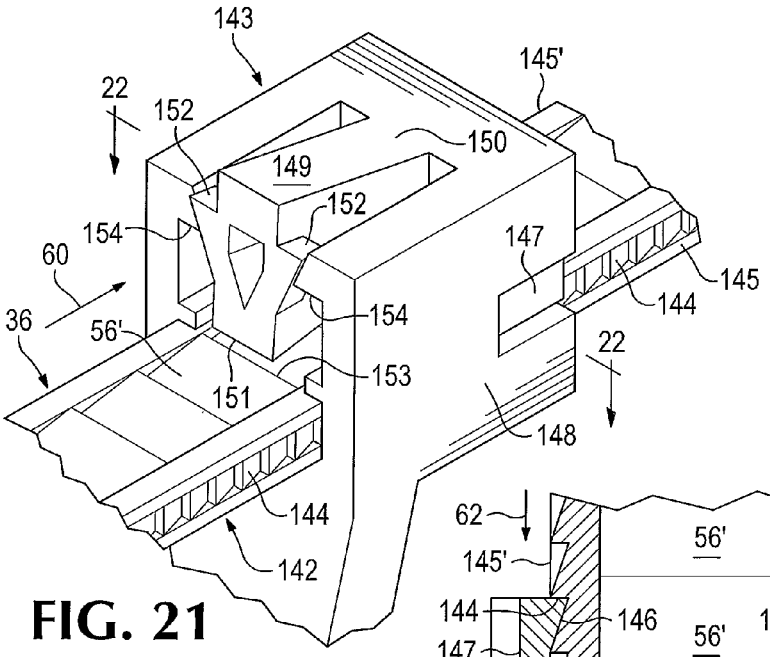
FIG. 21 is an enlarged isometric view of a portion of a fastener incorporating a sixth embodiment of the fastener locking mechanism, with a portion of the elongate body extending through the fastener head, in an unlocked condition.
Figure 22:
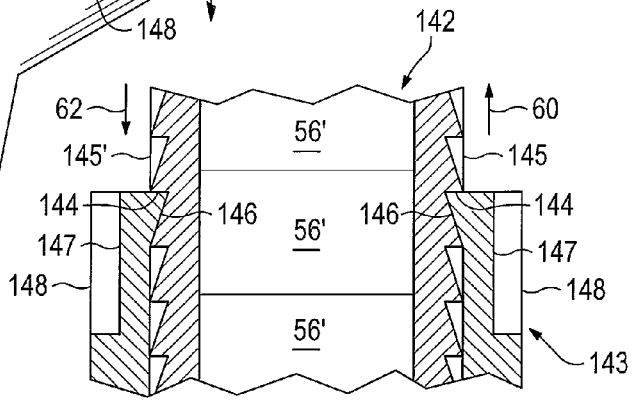
FIG. 22 is an enlarged sectional view of the ratcheting mechanism portion of the fastener shown in FIG. 21, taken along line 22-22 with a portion of the elongate body extending through the fastener head.
Figure 23:
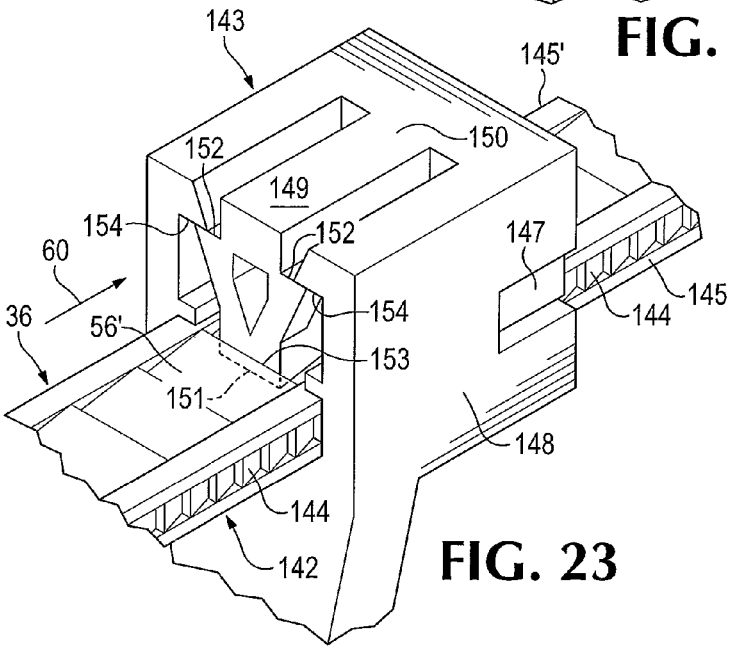
FIG. 23 is an enlarged isometric view similar to FIG. 21, showing the fastener locking mechanism with a portion of the elongate body extending through the fastener head, in a locked condition.

In another loop forming fastener 141 as shown in FIGS. 21-23, the elongate body portion 142 includes an array of teeth 56' on the first side 40 of the elongate body 142, but the teeth 56' are sloped oppositely with respect to the direction of movement through the head 143, indicated by the arrow 60, as required to tighten the loop 87. The elongate body portion 142 also includes two opposing arrays of ratchet teeth 144 located respectively on, and extending along, the length of the third and fourth sides 145, 145' of the elongate body 142. In this variation of the loop forming fastener, the teeth 144 are narrower than the teeth 56' on the first side 40 of the elongate body 142.

As best shown in FIG. 22, as the elongate body is pulled in the loop size reducing direction indicated by the arrow 60, the arrays of ratchet teeth 144 interact with pawls in the form of ears 146 on flexible arms 147, which extend outward from the side walls 148 of the head 143 and allow movement of the elongate body 142 in the direction of the arrow 60, but block movement of the elongate body 142 in the opposite direction indicated by the arrow 62.

The locking mechanism of the loop forming fastener 141 includes a cleat 149 which is attached to the top of the head 143 by means of a flexible cleat neck 150 and extends between the side walls of the head 143. The cleat 149 has a front face that defines cleat edge 151, having a width that is slightly less than the width of the teeth 56' on the first side of the elongate body 142, so that the edge 151 and the adjacent part of the front face of the cleat 149 can engage the narrow upright face 153 of one of the teeth 56'. The cleat 149 may also include a pair of cleat shoulders 152 including top faces which extend laterally toward the sides of the head 148. Catches 154 extend inward from the sides of the head 148 toward the cleat 149, and have inclined faces. Sloping undersides of the shoulders 152 can act as cams against the faces of the catches 154 and urge the side walls of the head 143 apart.

Once the loop 87 is of a chosen size, the user can secure the loop at such a size by pressing the cleat 149 toward the elongate body 142 until the cleat edge 151 blocks, or is in contact with one of teeth 56', as shown in FIG. 23. As the cleat 149 is so moved, the cleat shoulders 152 push the catches 154 apart and out of their way until the shoulders 152 pass around the catches 154 and the cleat edge 151 reaches the position shown in FIG. 23. Catches 154 then resiliently move back toward each other and the cleat shoulders 152 are then locked underneath the catches 154, thereby securing the elongate body 142 to the head 143 with the loop 87 at a chosen size.

FIGS. 24-28 show four different types of stoppers that can perform functions similar to that of the stopper 68 described with reference to FIGS. 1 and 2 for a loop forming fastener. In each case, illustrated in FIGS. 24-28, there is shown a head defining an opening or passageway 54 extending through it, and a portion of the respective elongate body of the loop forming fasteners shown extending through the passageway.

Figure 24:
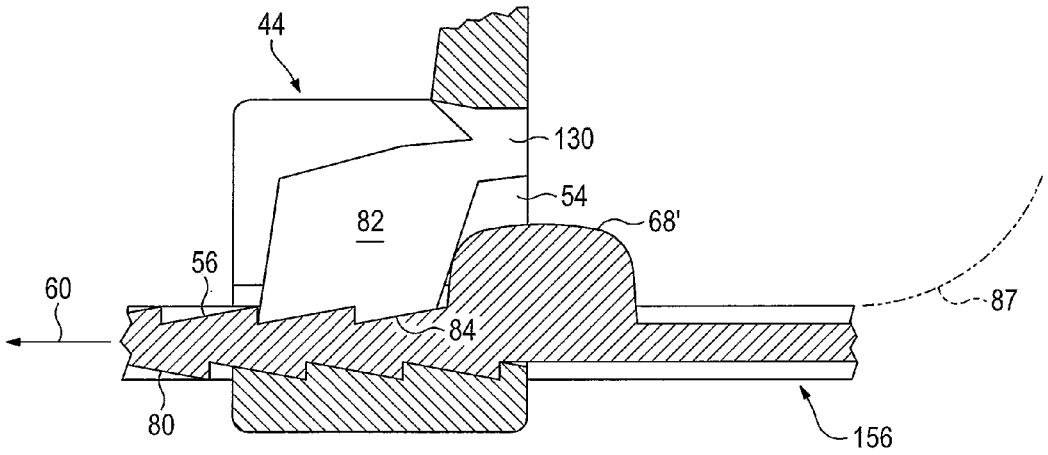
FIG. 24 is an enlarged sectional view of a portion of a fastener incorporating a seventh embodiment of the fastener locking mechanism, with a portion of the elongate body extending through the fastener head, in a locked condition.

The head 44, shown in FIG. 24, includes a pawl 82 mounted within the opening 54 by means of a short flexible neck 130. The elongate body 156 shown herein has an array of teeth 56 on its first side 40 and an array of teeth 80 on its second side 42. The pawl face 84 can engage the teeth 56 and 80, as a ratchet assembly previously described. A stopper 68', similar to, but of a shape slightly different from that of the stopper 68, is too large to pass by the pawl 82 and thus prevents reducing the size of the loop 87 beyond the size established by the location of the stopper 68', beyond which there are no ratchet teeth 56 or 80.

Figure 25:
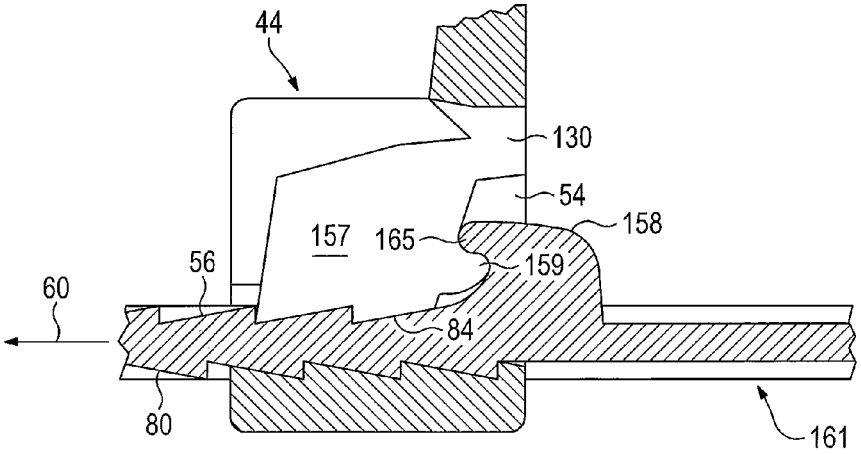
FIG. 25 is an enlarged sectional view of a portion of a fastener incorporating an eighth embodiment of the fastener locking mechanism, with a portion of the elongate body extending through the fastener head, in a locked condition.

A similar head 44 is shown in FIG. 25, but the pawl 157 and a stopper 158 both include cooperative hooks 159 and 165 that mate with each other to add security in preventing further tightening movement of the elongate body 161 through the head 44. When the hooked stopper 158 reaches the head 44, the hooked stopper 158 interacts with the hooked pawl 157 and holds the hooked stopper 158 in place. Any additional loop tightening, in the direction of the arrow 60, increases pressure on the hooked pawl 157 which further pushes the pawl face 84 into the teeth 56, and prevents movement in the direction of the arrow 60. The hooked stopper 158 also acts similarly to the curved stopper 68, in that it is too big to pass through the opening 54.

Figure 26:
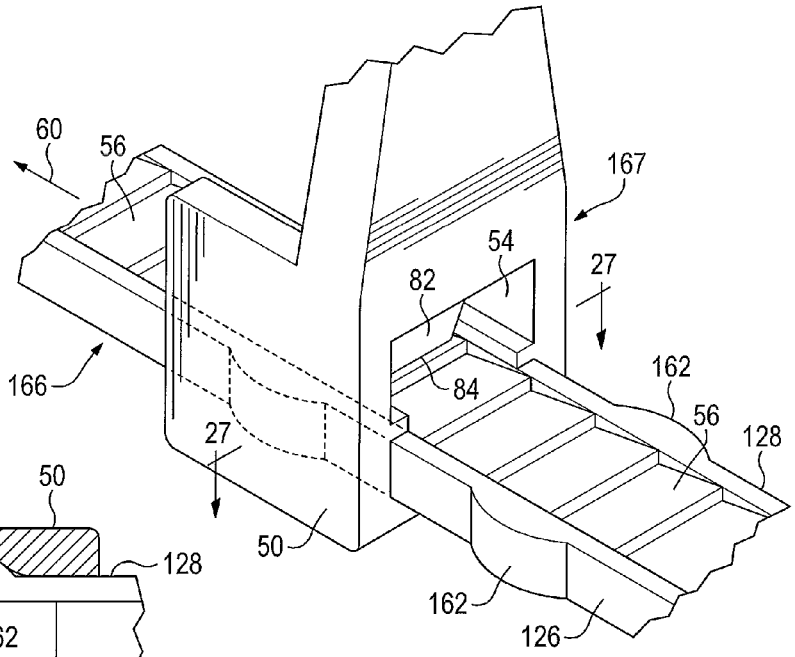
FIG. 26 is an enlarged isometric view of a portion of a fastener incorporating a ninth embodiment of the fastener locking mechanism, with a portion of the elongate body extending through the fastener head in a relationship establishing one of a plurality of predetermined loop sizes.
Figure 27:
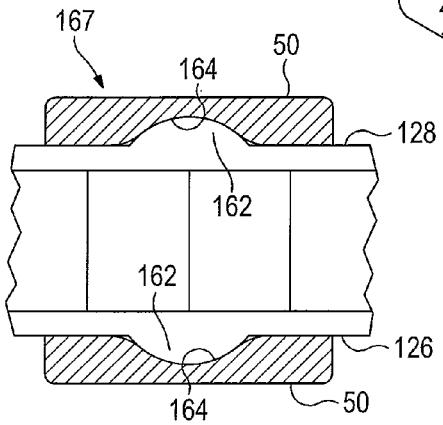
FIG. 27 is an enlarged sectional view, taken along line 27-27 in FIG. 26, showing the fastener locking mechanism with a portion of the elongate body extending through the fastener head, locked in a selected one of a plurality of possible positions.

As shown in FIGS. 26 and 27, the elongate body 166 may include a pair of laterally protruding parts which can include pairs of loop size restricting stoppers 162 in the form of protrusions which are located on the third and fourth sides 126, 128 of the elongate body 166, or a receptacle 164 may be provided for each such stopper within the sides of the head 167. Several such stoppers can be located along the elongate body 166, at convenient locations to permit the loop 87 to be established at a selected one of several sizes. In such an embodiment, the sides of the head 50 may be resiliently deformable such that with sufficient force, the engageable protrusions 162 can be pulled through the opening 54 without breaking the elongate body 166, and without damaging the head 167, the receptacles 164, or the stoppers 162. In another embodiment the protrusions 162 are deformable such that with sufficient force, the protrusions 162 can be pulled through the head 50. This embodiment may be described as having "multiple diameter loops" functionality.

Figure 28:
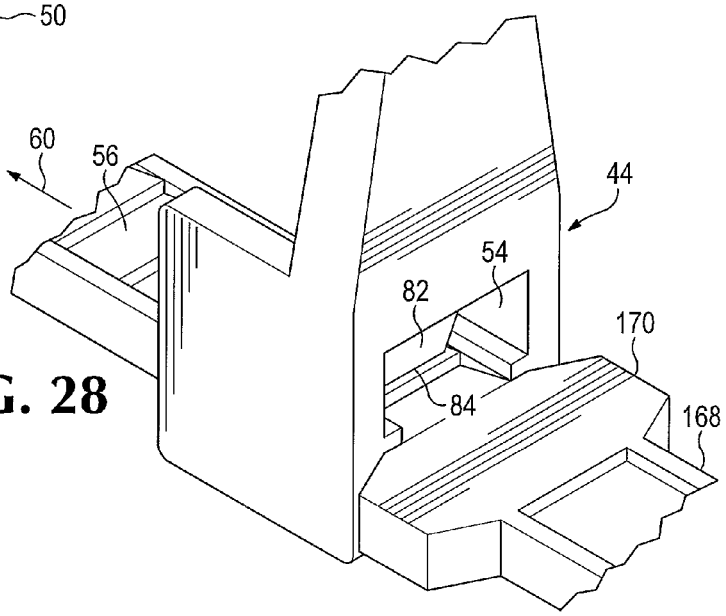
FIG. 28 is an enlarged isometric view of a portion of a fastener incorporating a tenth embodiment of the fastener locking mechanism, with a portion of the elongate body extending through the fastener head and engaged to form a loop of a minimum size.

As may be seen in FIG. 28, yet a further embodiment of the loop forming fastener has a head 44 similar to the one disclosed in FIGS. 24-25, but an elongate body 168 includes a stopper 170 extending laterally from the body 168. Upon reaching the opening into the passageway 54 the stopper 170 prevents further movement of the elongate body 168 in the direction of the arrow 60, thereby functioning as a loop size maintaining feature.

The form of all foregoing embodiments and elements may include symmetrical and asymmetrical variations of the embodiments.

The loop forming fasteners disclosed herein may also have additional features not shown or described in detail herein, attached to or extending from their heads or elongate bodies, allowing them to interact or be connected to with other devices including, but not limited to, flanges for mounting the fasteners to other objects, clip attachments, screw/bolt/fastener attachment points, and loops that allow one of the loop forming fasteners described above to be hooked onto or threaded onto other devices.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A loop forming fastener, comprising:

(a) an elongate body portion having a first end and an opposite tail portion and an intermediate portion, and having a first side and a second side;

(b) a head connected to the elongate body portion, the head defining an opening with a top, a bottom, and sides, the opening being configured to receive said tail portion of the elongate body portion and thereby form a loop;

(c) a ratchet mechanism including an array of teeth aligned on the first side of the elongate body portion, and at least one pawl associated with the head and with the opening, and the ratchet mechanism permitting movement of the elongate body portion therethrough in a first direction but preventing movement of the elongate body portion in an opposite second direction;

(d) an array of cavities arranged in a row spaced along the second side of the elongate body portion; and (e) a locking mechanism located in the bottom of the head, wherein the locking mechanism includes a foot and a locking shoulder, the foot being attached to the bottom of the head, the foot having a catch located proximate to the locking shoulder and extending in the direction of the opening, such that the catch on the foot is selectively engageable with the locking shoulder.

2. The loop forming fastener of claim 1, wherein the foot also includes at least one cog extending in the direction of the array of cavities, and the at least one cog extends into and engages at least one cavity when the foot is pushed toward said array of cavities.

3. The loop forming fastener of claim 1, wherein the locking shoulder extends from an outer end wall of the head, the foot is attached to the bottom of the head by a flexible base, and the attachment of the foot to bottom of the head via the flexible base is proximate to the opening.

4. The loop forming fastener of claim 1, wherein the foot also includes a second cog with a barb, such that when the elongate body portion is tugged in the second direction, the barb catches a cavity causing the foot to engage said locking shoulder.

5. The loop forming fastener of claim 1, wherein the ratchet mechanism includes a second array of teeth on the second side of the elongate body portion.

6. The loop forming fastener of claim 1, wherein the pawl has a pawl face which is shaped to correspond with the array of teeth, and wherein the locking mechanism secures the pawl face along a corresponding portion of the array of teeth when the foot is pushed toward said array of cavities, extending the cog into at least one cavity, and engaging the locking shoulder.

7. A loop forming fastener, comprising:

(a) an elongate body portion having a first end and an opposite tail portion and an intermediate portion, and having a first side and a second side;

(b) a head connected to the elongate body portion, the head defining an opening with a top, a bottom, and sides, configured to receive said tail portion of the elongate body portion and thereby form a loop;

(c) a ratchet mechanism including an array of teeth aligned on the first side of the elongate body portion, and at least one pawl associated with the head and with the opening, and the ratchet mechanism permitting movement of the elongate body portion therethrough in a first direction but preventing movement of the elongate body portion in an opposite second direction;

(d) an array of cavities arranged in a row and spaced along the second side of the elongate body portion;

(e) a locking mechanism located in the bottom of the head, wherein the locking mechanism includes a foot attached to the bottom of the head by a flexible base, the foot also having at least one cog extending in the direction of the array of cavities, and wherein the at least one cog extends into and engages at least one cavity when the foot is pushed toward said array of cavities to engage a locking shoulder to secure the elongate body portion at a selected loop position; and (f) wherein the foot also includes a second cog with a barb, such that when the elongate body portion is tugged in the second direction, the barb catches a cavity causing the foot to engage said locking shoulder.

8. The loop forming fastener of claim 7, wherein the ratchet mechanism includes a second array of teeth on the second side of the elongate body portion.

9. The loop forming fastener of claim 7, wherein the pawl has a pawl face which is shaped to correspond with the array of teeth, and wherein the locking mechanism secures the pawl face along a corresponding portion of the array of teeth when the foot is pushed toward said array of cavities, extending the cog into at least one cavity, and engaging the locking shoulder.

10. The loop forming fastener of claim 7, wherein the array of cavities is an array of holes.

* * * * *